US005277304A

United States Patent [19]

Brizzi et al.

[11] Patent Number: 5,277,304

[45] Date of Patent: Jan. 11, 1994

[54] PACKET OF CIGARETTES

[75] Inventors: Marco Brizzi, Zola Predosa; Eros Stivani; Antonio Gamberini, both of Bologna, all of Italy

[73] Assignee: G.D. Societa Per Azioni, Bologna, Italy

[21] Appl. No.: 962,729

[22] Filed: Oct. 19, 1992

[30] Foreign Application Priority Data

Oct. 23, 1991 [IT] Italy ..... BO91A000390

[51] Int. Cl.[5] ..... B65D 85/10

[52] U.S. Cl. ..... 206/256; 206/268

[58] Field of Search ..... 206/256, 268, 271, 257, 206/261

[56] References Cited

U.S. PATENT DOCUMENTS

| | | | |
|---|---|---|---|
| 3,039,671 | 6/1962 | Chiamardas | 206/268 X |
| 3,489,272 | 1/1970 | Rosen | 206/256 |
| 3,752,308 | 8/1973 | Begemann | 206/256 |
| 4,081,126 | 3/1978 | Barnard | 206/256 |
| 4,738,359 | 4/1988 | Phillips, Jr. | 206/256 |
| 4,784,261 | 11/1988 | Kutchin | 206/256 |
| 4,912,910 | 4/1990 | Lowe et al. | 53/429 |
| 4,961,496 | 10/1990 | Focke et al. | 206/246 |
| 5,143,213 | 9/1992 | Moore et al. | 206/268 |

*Primary Examiner*—William I. Price

*Attorney, Agent, or Firm*—Cushman, Darby & Cushman

[57] ABSTRACT

In a cigarette packet appearing essentially as a parallelepiped body capable of accommodating at least two groups of cigarettes enveloped in respective wrappers surrounded by at least one internal collar, the body and wrappers each exhibit a front face, a rear face and two flank faces; the individually wrapped groups of cigarettes are positioned one adjacent to the other with the relative wrappers in mutual contact by way of the broader front and rear faces rather than by way of the flanks.

12 Claims, 2 Drawing Sheets

PACKET OF CIGARETTES

BACKGROUND OF THE INVENTION

The present invention relates to a packet of cigarettes.

The invention relates in particular to a rigid type of cigarette packet with a flip-top hinged lid, but is also applicable to the soft, crush type packets. Cigarette packets currently in use include a type embodied in such a way as to accommodate two distinct internal wrappers, each enveloping a respective group of cigarettes, disposed one beside the other and in mutual contact along two flanks, that is, offering one of two narrower faces one to another. The packets in question exhibit a flat, elongated configuration, and more exactly, a relatively small lesser dimension or depth (generally corresponding to the depth of a double layer of cigarettes), and a relatively large greater dimension, or breadth. Clearly, when filled with an appreciable number of cigarettes, i.e. a number greater than 20 or 25, the breadth dimension of packets embodied in this way tends to take on proportions, commensurate with the depth of the groups of cigarettes, that lead to difficulties in manufacture when using conventional packaging machines to and to problems with use.

The object of the present invention is to provide a packet of cigarettes unaffected by the drawbacks mentioned above.

SUMMARY OF THE INVENTION

The stated object is realized, according to the invention, in a packet of cigarettes consisting in a body containing at least two groups of cigarettes enveloped in respective wrappers and at least one collar anchored internally to the body, wherein the body and the wrappers each exhibit a front face, a rear face and two flanks. The individually wrapped groups of cigarettes are distinct one from another and disposed in mutual contact by way of respective front and rear faces exhibiting dimensions greater than those of the relative flank faces.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 2:
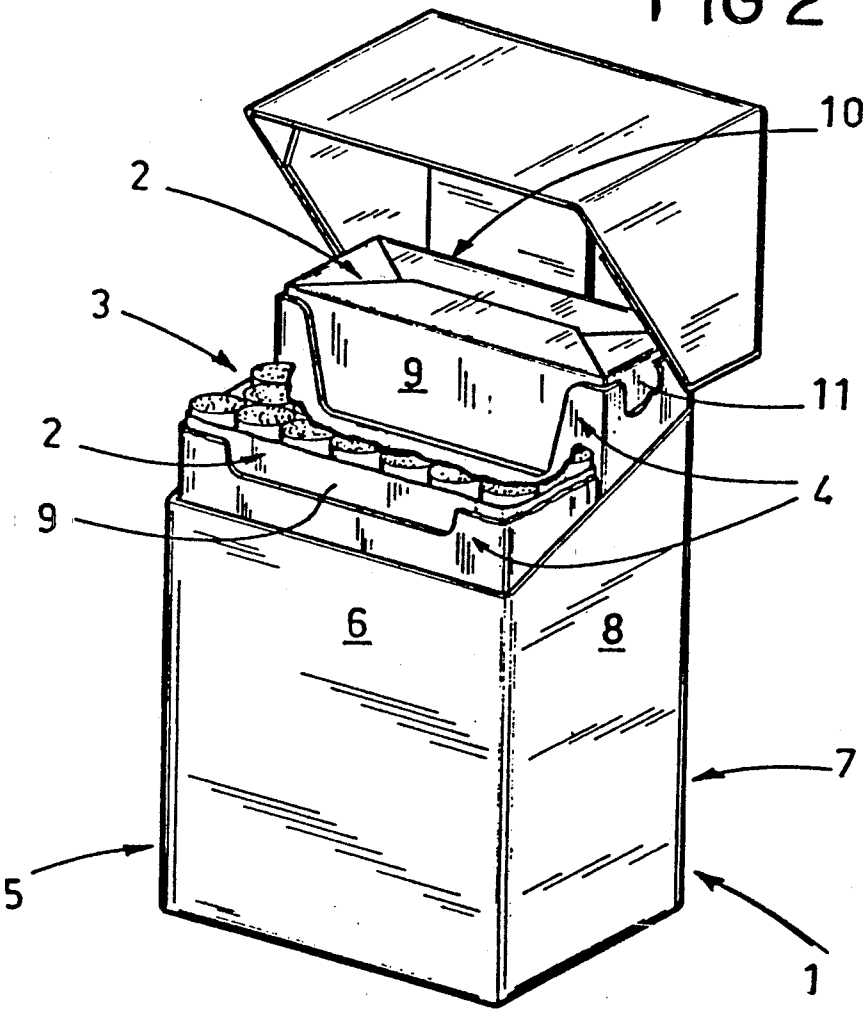
FIG. 2 illustrates an alternative embodiment of the packet of FIG. 1, viewed in perspective with certain parts cut away to better reveal others.

A packet 1 of cigarettes according to the present invention is designed generally to contain a large number of cigaretteS. Such a large number of cigarettes, naturally enough, may be taken to be a number greater than 20 or 25, the contents of an ordinary packet. Such a packet may be of the rigid box type with a hinged lid, or of the softer crush type, and consists in a body 5 containing at least two groups of cigarettes 3 enveloped in respective wrappers 2, and a collar 4 anchored internally to the body 5. The body 5 presents a front face 6, a rear face 7 and two flanks 8. Likewise, each wrapper 2 presents a front face 9, a rear face 10 and two flanks 11.

The two separate wrappers 2 contained by the body 5 of the packet 1 are disposed in mutual contact by way of two corresponding faces, front 9 and rear 10 respectively, of which the transverse dimensions are greater than those of the flank face 11. As discernible from the accompanying drawings, the packet 1 appears parallelepiped in shape, with a substantially square base, and is thus easier to handle than the essentially flat packets currently in use.

Figure 1:
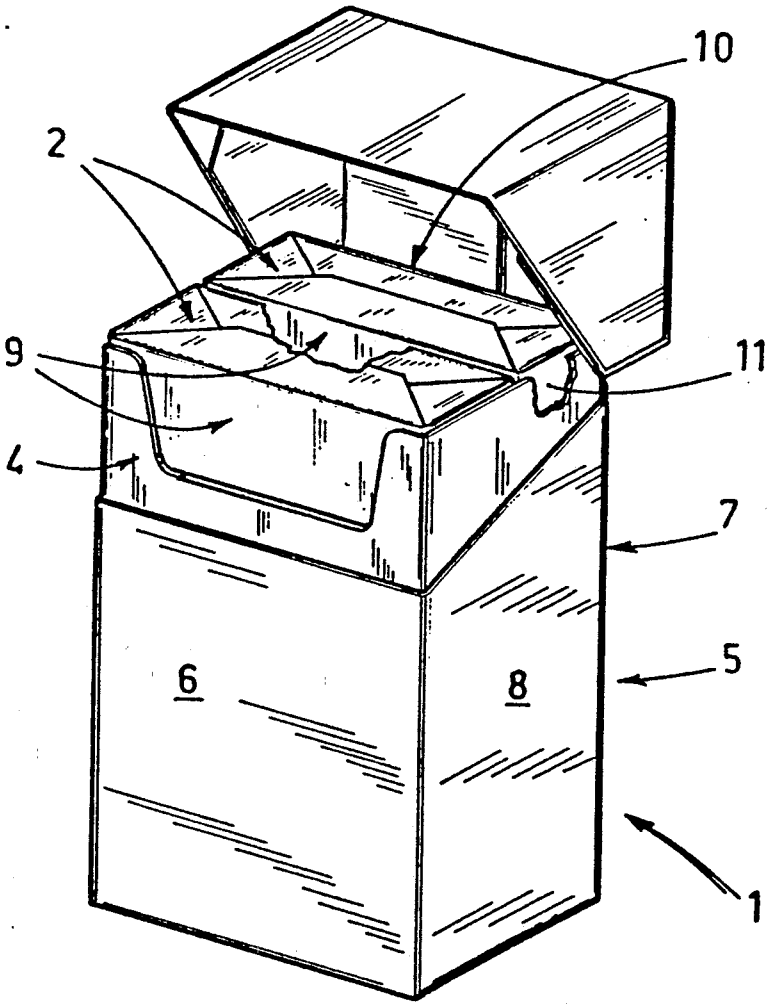
FIG. 1 illustrates a first preferred embodiment of a large capacity packet of cigarettes according to the invention, viewed in perspective and in an open configuration.
Figure 3:
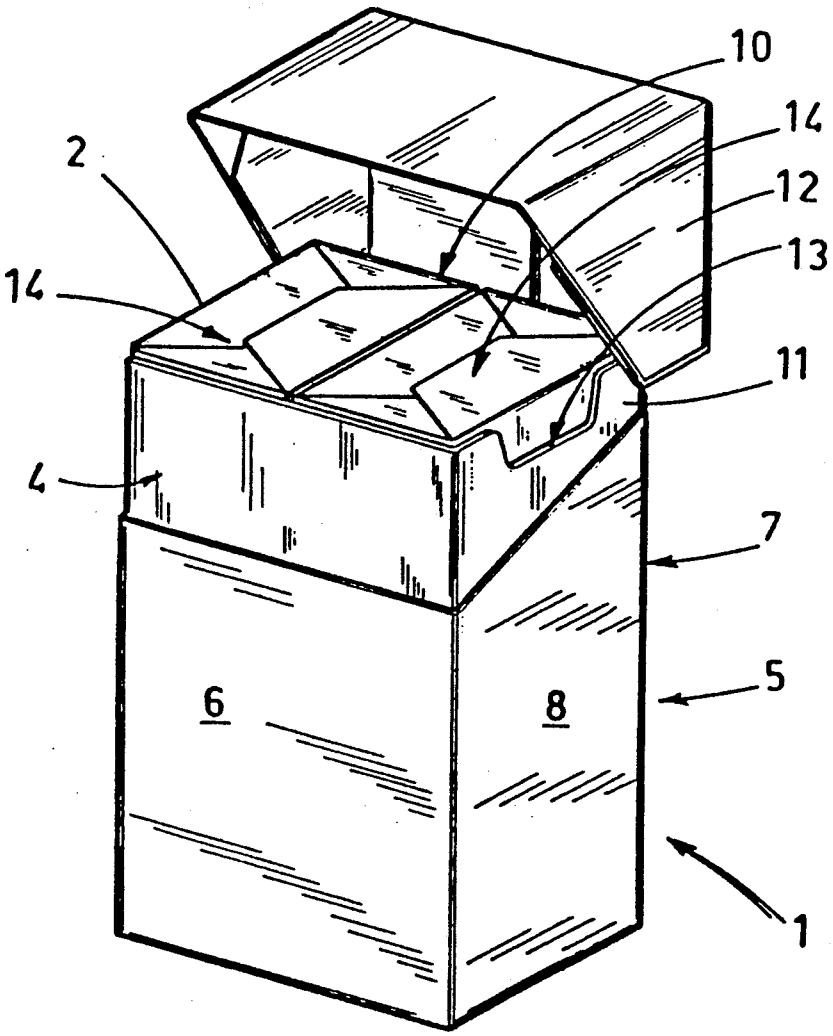
FIG. 3 illustrates a third embodiment of the packet of FIG. 1, seen in perspective.

The body 5 might be fitted internally with just one collar 4 encompassing both of the wrappers 2, as illustrated in FIGS. 1 and 3. In this instance, with one of the wrappers 2 emptied, the retention of the remaining cigarettes is entrusted entirely to the relative wrapper 2 which, however, may tend to give way for lack of support.

Figure 4:
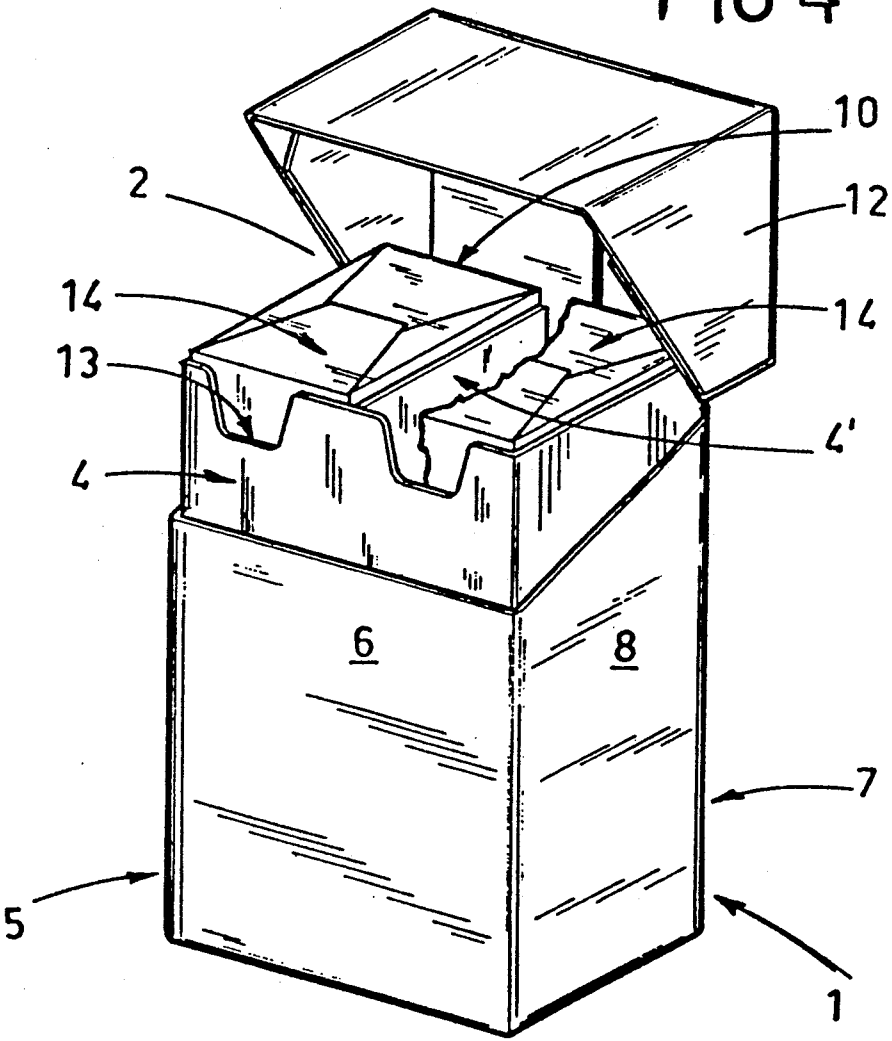
FIG. 4 illustrates an alternative embodiment of the packet of FIG. 2, seen in perspective.

In the example of FIGS. 2 and 4, the body 5 is fitted with two distinct collars 4. One to each wrapper 2, more particularly, in FIG. 4 the two collars in question are created by the addition of a dividing element 4' to the normal single collar 4, of which the function is to separate the two wrappers 2.

The cigarettes are invested with greater stability in this latter embodiment, inasmuch as when either one wrapper 2 or the other is removed ultimately, once emptied, the remaining cigarettes are held in their correct position by the relative compartment of the collar 4, which is fixed permanently to the body 5.

The packet 1 disclosed is easily produced using manufacturing machines currently in use. By providing a wrapper 2 for each row or pair of rows of cigarettes, the stability of the cigarettes themselves can be significantly enhanced.

In the embodiments of FIGS. 2 and 4 in particular, the cigarettes are maintained constantly in their correct position and formation while still in the packet, with no risk of creasing and/or damage. Where the packet 1 is of a rigid type with a hinged flip-top lid, as illustrated in the accompanying drawings, the wrappers 2 can be accommodated in the body 5 with front and rear faces 9 and 10 disposed either parallel or perpendicular to the hinge axis of the lid 12, as shown respectively in FIGS. 1 and 2 and in FIGS. 3 and 4.

In the embodiment of FIG. 3, which affords a single collar 4 surrounding both wrappers 2, and in which the front and rear faces 9 and 10 in mutual contact are disposed perpendicular to the hinge axis of the lid 12, the collar 4 might incorporate a cutaway 13 coinciding with one of the flanks 8 of the body 5 and serving to facilitate removal of the topmost part of the wrapper 2. In FIG. 4, by contrast, the collar 4 affords two such cutaways 13 coinciding with the front face 6 of the body 5, one for each of the two wrappers 2. In this instance the flap 14 pulled by the consumer to remove of the top part of wrapper 2 is associated with the relative flank 11 rather than with the front face 9.

Embodiments relative to the crush type of packet, though not shown in the drawings, are similar to those already illustrated but without the lid 12.

What is claimed:

1. A packet of cigarettes comprising:

a hollow rigid body having a base, a lid, a front face, a rear face, and two outer flank faces;

at least one collar fixed to said body; and at least two cigarette wrappers for containing respected groups of cigarettes, said wrappers being disposed within said body and each having (i) first and second inner flank faces, (ii) two broader faces of a greater dimension than said first and second inner flank faces, and (iii) an access portion through which said cigarettes can be accessed, each of said wrappers being arranged to have at least one of its two broader faces facing a respective broader face of another of said wrappers, said lid of said body being openable to permit access to said cigarettes through said access portion of said wrappers.

2. A packet of cigarettes as claimed in claim 1, wherein said cigarette wrappers are arranged such that said first inner flank faces and said second inner flank faces respectively lie in substantially the same plane, said first and second inner flank faces each having their respective added dimensions being substantially equal to the dimension of one of said broader faces.

3. A packet of cigarettes as claimed in claim 2, wherein said hollow body has a substantially square base.

4. A packet of cigarettes as claimed in claim 1, wherein said at least one collar surrounds said wrappers.

5. A packet of cigarettes as claimed in claim 2, wherein said at least one collar surrounds said wrappers.

6. A packet of cigarettes as claimed in claim 1, wherein said at least one of said two broader faces of each wrapper is in mutual contact with said respectively facing broader face of said another of said wrappers.

7. A packet of cigarettes comprising:

a parallelepiped rigid body having a substantially square base, four side faces, and a lid being connected to said body by a hinge;

at least two cigarette wrappers for containing respective groups of cigarettes, said wrappers being disposed within said body and each having two flank faces and two broader faces of a greater dimension than said flank faces, each of said wrappers being arranged to have at least one of its two broader faces facing a respective broader face of another of said wrappers; and a collar fixed to said body, said collar surrounding said wrappers.

8. A packet of cigarettes as claimed in claim 7, wherein said wrappers are alternatively arrangeable within said rigid body between a configuration in which said broader faces of said wrappers extend in a direction parallel to an axis of said hinge and a configuration in which said broader faces of said wrappers extend in a direction perpendicular to said axis of said hinge.

9. A packet of cigarettes comprising:

a parallelepiped rigid body having a substantially square base, a front face, a rear face, and two outer flank faces;

at least two cigarette wrappers for containing respective groups of cigarettes, said wrappers being disposed within said body and each having first and second inner flank faces and two broader faces of a greater dimension than said first and second inner flank faces, each of said wrappers having at least one of its two broader faces facing a respective broader face of another of said wrappers; and at least two collars, each of which is fixed to said body and surrounds a respective one of said wrappers.

10. The packet of cigarettes as claimed in claim 9, further comprising a lid, said lid being connected said body by a hinge, said hinge having an axis about which said lid is moveable.

11. A packet of cigarettes as claimed in claim 10, wherein said broader faces extend in a direction parallel to said axis of said hinge.

12. A packet of cigarettes as claimed in claim 10, wherein said broader faces extend in a direction perpendicular to said axis of said hinge.

* * * * *